United States Patent [19]

Pelcin

[11] 4,321,812

[45] Mar. 30, 1982

[54] PADDLE LOCK WITH PIVOTALLY MOUNTED HANDLE DISCONNECT MEMBER

[75] Inventor: Albert L. Pelcin, Aurora, Ohio

[73] Assignee: The Eastern Company, Cleveland, Ohio

[21] Appl. No.: 108,010

[22] Filed: Dec. 28, 1979

[51] Int. Cl.[3] ..... E05B 55/04; E05C 1/14

[52] U.S. Cl. ..... 70/472; 70/149; 70/204; 70/218; 70/489; 292/173; 292/226; 292/DIG. 27; 292/DIG. 31

[58] Field of Search ..... 70/472, 488, 489, 149, 70/204, 218, 221–224, 416; 292/167, 173, 223, 226, DIG. 27, DIG. 31, DIG. 37

[56] References Cited

U.S. PATENT DOCUMENTS

| | | |
|---|---|---|
| 269,953 | 1/1883 | Moritz . |
| 528,450 | 10/1894 | Swanberg . |
| 1,751,184 | 3/1930 | Wodarra . |
| 1,785,381 | 12/1930 | Holtzman . |
| 1,840,062 | 1/1932 | Taylor . |
| 1,909,210 | 5/1933 | Miller . |
| 1,911,564 | 5/1933 | Gahagan . |
| 1,960,410 | 5/1933 | Christensen . |
| 1,964,066 | 6/1934 | Kuszmaul . |
| 2,053,805 | 9/1936 | Van Note . |
| 2,075,948 | 4/1937 | Kuszmaul . |
| 2,117,715 | 5/1938 | Godfried . |
| 2,274,455 | 2/1942 | Murphy . |
| 2,322,892 | 6/1943 | Springer . |
| 2,453,505 | 11/1948 | Fornwald . |
| 2,459,029 | 1/1949 | Ingres et al. . |
| 2,468,644 | 4/1949 | Springer . |
| 2,582,928 | 1/1952 | Dall . |
| 2,603,963 | 7/1952 | Allen . |
| 2,629,618 | 2/1953 | Roethel . |
| 2,649,321 | 8/1953 | Smith . |
| 2,658,781 | 11/1953 | Allen . |
| 2,700,290 | 1/1955 | Dall . |
| 2,705,882 | 4/1955 | Craig . |
| 2,705,884 | 4/1955 | Craig . |
| 2,723,145 | 11/1955 | Smith . |
| 2,728,214 | 12/1955 | Craig . |
| 2,772,908 | 12/1956 | Craig . |
| 2,773,716 | 12/1956 | Craig . |
| 2,782,062 | 2/1957 | Smith . |
| 2,877,043 | 3/1959 | Leslie . |
| 2,955,864 | 10/1960 | Van Voorhees . |
| 2,978,895 | 4/1961 | Heisler . |
| 2,987,907 | 6/1961 | Cockburn et al. . |
| 3,007,731 | 11/1961 | Roethel . |
| 3,069,889 | 12/1962 | Johnstone et al. . |
| 3,104,124 | 9/1963 | Beck . |
| 3,121,580 | 2/1964 | Di Salvo et al. . |
| 3,129,026 | 4/1964 | Gergoe et al. . |
| 3,153,551 | 10/1964 | Sandor et al. . |
| 3,171,677 | 3/1965 | Klove, Jr. et al. . |
| 3,309,127 | 3/1967 | Pickles . |
| 3,314,708 | 4/1967 | Welch . |
| 3,386,760 | 6/1968 | Bessette . |
| 3,394,957 | 7/1968 | Foley . |
| 3,423,117 | 1/1969 | Klove, Jr. et al. . |
| 3,587,259 | 6/1971 | Sandor . |
| 3,649,061 | 3/1972 | Meyer . |
| 3,672,713 | 6/1972 | Pickles . |
| 3,679,251 | 7/1972 | Brockman et al. . |
| 3,695,660 | 10/1972 | Fetters . |
| 3,695,663 | 10/1972 | Cockburn . |
| 3,697,105 | 10/1972 | Marx . |
| 4,116,027 | 9/1978 | Tannery ..... 70/472 |
| 4,170,119 | 10/1979 | Kalis, Jr. ..... 70/149 X |

FOREIGN PATENT DOCUMENTS

| | | |
|---|---|---|
| 135399 | 9/1947 | Australia . |
| 717308 | 2/1942 | Fed. Rep. of Germany . |
| 232079 | 4/1925 | United Kingdom ..... 292/DIG. 27 |

OTHER PUBLICATIONS

Brochure Describing a Complex Atwood Lock.

*Primary Examiner*—William E. Lyddane
*Attorney, Agent, or Firm*—Burge & Porter Co.

[57] ABSTRACT

A door lock has a flush-mountable body. A forwardly facing recess is defined by the body. A paddle-type handle is pivotally carried by the body and is movable between a nested position within the body recess and an operating position. A spring-projected slide bolt is carried on the back of the body and is movable between projected and retracted positions. A key-controlled disconnect linkage is provided for selectively connecting and disconnecting the handle and the bolt. The disconnect linkage includes a mounting member which extends longitudinally along one side of the bolt and which is drivingly engaged by the handle. A disconnect member is supported on the mounting member and is arranged to be pivoted from side to side between connecting and disconnecting positions by the movement of a key-operated locking member. When the disconnect member is in its disconnecting position, the disconnect linkage makes no driving connection between the handle and the bolt, whereby movement of the handle causes no corresponding movement of the bolt. When the disconnect member is in its connecting position, the disconnect linkage provides a driving connection between the handle and the bolt, whereby movement of the handle from its nested position to an operating position will cause corresponding retracting movement of the bolt. A feature of the disconnect linkage is that it provides the lock with a "slam" capability, meaning that when the bolt is projected, it can be slammed into latching engagement with a suitably configured strike regardless of whether the disconnect linkage is drivingly connecting or disconnecting the handle and the bolt.

38 Claims, 6 Drawing Figures

PADDLE LOCK WITH PIVOTALLY MOUNTED HANDLE DISCONNECT MEMBER

CROSS-REFERENCE TO RELATED APPLICATIONS

PADDLE LOCKS WITH HANDLE DISCONNECT FEATURES, Ser. No. 108,007 filed concurrently herewith on Dec. 28, 1979 by John V. Pastva, Jr., hereinafter "Disconnect Case I."

PADDLE LOCK WITH BOLT-CARRIED HANDLE DISCONNECT MEMBER, Ser. No. 107,859 filed concurrently herewith on Dec. 28, 1979 by John V. Pastva, Jr. and Albert L. Pelcin, hereinafter "Disconnect Case III."

PADDLE LOCK WITH ROTATABLY-MOUNTED HANDLE DISCONNECT MEMBER, Ser. No. 108,017 filed concurrently herewith on Dec. 28, 1979 by James A. Reed and Edwin W. Davis, hereinafter "Disconnect Case IV."

PADDLE LOCK WITH TRANSLATABLY-MOUNTED HANDLE DISCONNECT MEMBER, Ser. No. 108,015 filed concurrently on Dec. 28, 1979 by Edwin W. Davis, hereinafter "Disconnect Case V."

PADDLE LOCK WITH HANDLE DISCONNECT, Ser. No. 108,016 filed concurrently herewith on Dec. 28, 1979 by Jye P. Swan, John V. Pastva, Jr. and Donald J. Dignan, hereinafter "Disconnect Case VI."

PADDLE LOCK WITH GUARD-PROTECTED HANDLE DISCONNECT MEMBER, Ser. No. 107,858 filed concurrently herewith on Dec. 28, 1979 by Edwin W. Davis, hereinafter "Disconnect Case VII."

FLUSH-MOUNTABLE LOCK WITH ACTUATOR DISCONNECT FEATURE, Ser. No. 108,011 filed concurrently herewith on Dec. 28, 1979 by Edwin W. Davis, hereinafter "Disconnect Case VIII."

The present application and the applications cross-referenced above have been assigned to a common entity, The Eastern Company, a corporation of Connecticut.

BACKGROUND OF THE INVENTION

1. Field of the Invention

The present invention relates generally to a door lock having a spring-projected slide bolt, a handle for retracting the bolt, and a key control for selectively permitting and preventing the handle from retracting the bolt. More particularly, the invention relates to a lock of this type including a key-controlled disconnect linkage for selectively drivingly connecting and disconnecting the handle and the bolt, whereby the handle is, at all times, freely movable between normal and operating positions, but is functional only when the key control is "unlocked" to enable the handle to retract the bolt.

While the present invention has particularly advantageous use in conjunction with flush-type door locks used on swinging doors of vehicles, industrial cabinets, electrical equipment enclosures and the like, principles of the invention are not limited in application to such uses.

2. Prior Art

Flush-type door locks including a body, a lock bolt slidably carried on the body, and an operating handle for moving the bolt relative to the body are well known. Normally the handle is in a flush or nested position when the bolt is projected. Bolt retraction is effected by pivoting the handle to an operating position. Locks of this type are well suited for use on swinging doors of vehicles such as trucks, on merchandise, tool and equipment cabinets, electrical equipment enclosures and the like.

Flush-type, paddle-handle door locks employing key-operated rotatable cams for selectively permitting and preventing unlocking movements of operating handles, and having spring-projected slide bolts, are described in U.S. Pat. Nos. 3,707,862, and 3,668,907 granted Jan. 2, 1973 and June 13, 1972, respectively, to John V. Pastva, Jr. An ornamental appearance employed in locks of this general type is illustrated in U.S. Design Pat. No. 230,132 issued Jan. 29, 1974 to John V. Pastva, Jr.

The provision of a handle disconnect feature in a door lock is desirable in that the presence of such a feature will lessen, if not totally eliminate, incidents of these locks being damaged by would-be intruders. Since the handles of most previously proposed door locks are restrained from moving when the locks are locked, it is common for would-be intruders to attempt to gain entry by applying excessive leverage force to the lock handles. Where handle disconnect features are provided, the lock handles may always be moved freely, but are functional to retract the bolt only when the locks are "unlocked." Locks having handle disconnect features can be made practically entry-proof short of the application of such forces as will totally destroy the locks.

Door locks employing various types of handle disconnect systems have been proposed. Prior proposals have, however, suffered from a variety of drawbacks including complexities of construction; failures to mount all of the operating parts of a lock on a single body member so that the resulting locks form compact, easy to install units; and inappropriately configured parts of sizes and shapes that prohibit installation of locks embodying such proposals in conventionally configured door lock mounting openings.

The Cross-Referenced Disconnect Cases

The present invention and the inventions described in the several referenced Disconnect Cases represent the work products of a continuous and continuing development program which began nearly a decade ago.

The several handle disconnect systems described in the referenced Disconnect Cases were developed by co-workers operating, in some instances independently, and in other instances jointly, as is reflected in the naming of sole and joint inventors. Many of the disconnect system features claimed in separate ones of the referenced Disconnect Cases were developed substantially concurrently.

Where a claim in one of the referenced Disconnect Cases is found to be generic to a development concept utilized in another of these cases, it should be understood that care has been taken to present the generic claim in the case which describes the earliest development of a species that will support the generic claim. In this manner, a careful effort has been made to establish clear lines of demarcation among the claimed subjects matter of this and the several referenced Disconnect Cases. No two of these cases include claims of identical scope.

SUMMARY OF THE INVENTION

The present invention overcomes the foregoing and other drawbacks of the prior proposals by providing a novel and improved, reliable and durable, handle-operated door lock which includes a simple but effective key-controlled disconnect linkage for selectively drivingly connecting and disconnecting an operating handle and a spring-projected slide bolt.

A door lock embodying principles of the present invention preferably includes a support structure or body having side and back walls which cooperate to define a forwardly-facing recess. A bolt is slidably supported on the body at a location behind the back wall. The bolt is movable between projected and retracted positions with respect to the body, and a compression coil spring biases the bolt toward its projected position. A handle is supported on the body for swinging movement between a nested position and an operating position.

A key-controlled disconnect linkage has a locking member which is movable between locked and unlocked positions. A mounting member extends longitudinally along one side of the bolt and is drivingly engageable by the handle. A disconnect member is pivotally connected to the mounting member and is pivoted from side-to-side by the locking member between positions wherein the disconnect member selectively drivingly connects and disconnects the handle and the bolt. When the locking member is in its locked position, the disconnect member disconnects the handle and the bolt such that movement of the handle will cause no corresponding movement of the bolt. When the locking member is in its unlocked position, the disconnect member is operable to drivingly connect the handle and the bolt such that, when the handle is moved out of its nested position to an operating position, the bolt is retracted.

The disconnect linkage includes several improvements over previously proposed handle disconnect systems. It is formed from relatively simple and inexpensive components which occupy very little space and which provide a disconnect function at a readily accessible and servicable location behind the bolt housing. Interengageable formations are provided on the bolt and on the disconnect member. When the disconnect member is in its connecting position, the interengageable formations engage to provide a driving connection between the handle and the bolt. When the disconnect member is in its disconnecting position, the interengageable formations disengage and provide no driving connection between the handle and the bolt.

A feature of locks embodying the preferred practice of the present invention is that lock bodies and handles of essentially conventional configuration may be utilized thereby giving these locks about the same dimensional configuration and appearance as previously proposed locks which had no handle disconnect features.

As will be apparent from the foregoing summary, a feature of the present invention lies in the provision of a novel and improved door lock with a key-controlled disconnect system for selectively drivingly connecting and disconnecting the handle and the bolt.

These and other features and a fuller understanding of the present invention may be had by referring to the following detailed description and claims taken in conjunction with the accompanying drawings.

DESCRIPTION OF THE PREFERRED EMBODIMENT

Figure 1:
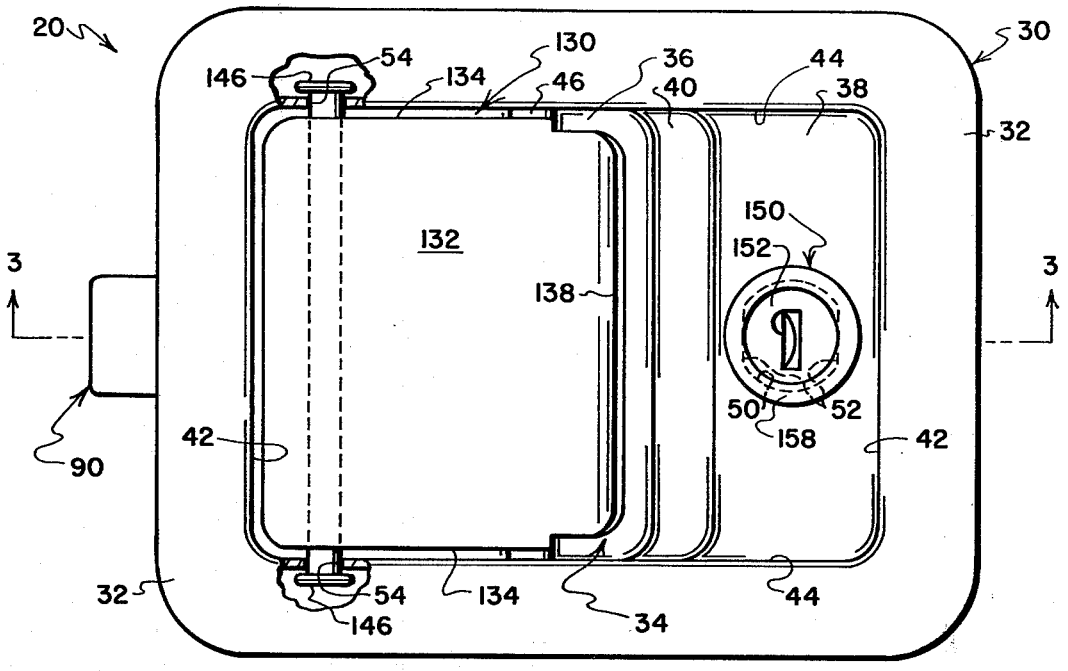
FIG. 1 is a front side elevational view of a lock embodying the preferred practice of the present invention with portions broken away to permit underlying components to be viewed, with the components of the lock being positioned in a locked attitude, with the handle nested and the bolt projected.

Referring to FIGS. 1–6, a key-controlled, paddle-handle, flush-mountable lock embodying the preferred practice of the present invention is indicated generally by the numeral 20. The lock 20 is adapted to be supported on such structures as a swinging door (not shown) for relative movement therewith to bring the lock 20 into and out of juxtaposition with a suitably configured conventional strike (not shown) supported on a door frame or other structure (not shown). The manner in which locks of this general type are mounted on doors is well known to those skilled in the art. The mounting of such locks is described and illustrated in such U.S. Pat. Nos. as Pastva, Jr., 3,668,907.

In general, the lock 20 includes a recessed body 30 having a bolt housing 60 welded to the rear side of the body 30. The bolt housing 60 and the back wall of the body 30 cooperate to define elongate passage 70. A bolt 90 is slidably carried in the passage 70 for movement between retracted and projected positions. A compression coil spring 110 biases the bolt 90 toward its projected position. A paddle handle 130 is pivotally carried on the body 30 for movement between nested and operating positions. A key control 150 and a disconnect linkage 180 are provided for selectively drivingly interconnecting and disconnecting the handle 130 and the bolt 90. The disconnect linkage 180 includes a mounting member 182 and a disconnect member 184. A compression coil spring 250 is interposed between the bolt 90 and the mounting member 182 for biasing the members 182, 184 leftwardly, relative to the bolt 90, as viewed in FIG. 3.

The body 30 is a rectangular, pan-shaped metal stamping having a perimetrically extending flange 32 which surrounds a forwardly facing recess 34. Left and right back wall portions 36, 38 define levels of different depths in opposite end portions of the recess 34. An inclined back wall portion 40 interconnects the left and right back wall portions 36, 38. Forwardly extending end walls 42 and side walls 44 connect the back wall portions 36, 38, 40 with the flange 32.

Other features of the body 30 include a pair of stops 46 formed in the left back wall portion 36. The stops 46 project into the recess 34 at locations near the side walls 44, and are engaged by the handle 130 when the handle 130 is in its nested position. An elongate slot 48 is provided in the left back wall portion 36 at a location overlying the bolt 90. A hole 50 is formed through the right back wall portion 38. Opposite sides of the hole 50 have flat, parallel-extending surfaces 52. Aligned holes 54 are formed through the side walls 44 near their left ends.

The bolt housing 60 is a channel-shaped sheet metal stamping having a bottom wall 62, a pair of opposed side walls 64, an end wall 66, and a pair of mounting flanges 68. The flanges 68 overlie and are welded to the rear side of the left back wall portion 36. An elongate slot 80 is formed through the bottom wall 62.

Figure 3:
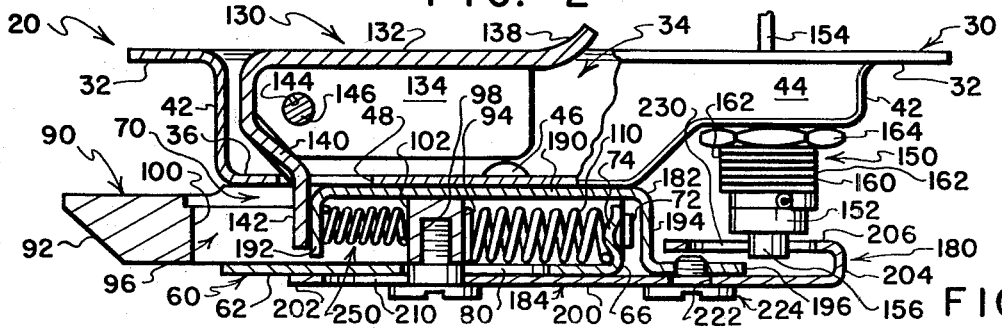
FIG. 3 is a bottom plan view with portions broken away and shown in cross section as seen from a plane indicated by a line 3—3 in FIG. 1, with the components of the lock positioned as shown in FIG. 3.

The bolt housing 60 cooperates with the left back wall portion 36 to define the passage 70 within which the bolt 90 is guided for sliding movement. The end wall 66 is formed as an integral part of the bottom wall 62, and operates to close a majority of the area of the right end of the bolt passage 70. As is best seen in FIG. 3, the end wall 66 stops short of the rearward surface of the left back wall portion 36, permitting the mounting member 182 to be slidably carried therebetween. The side walls 64 have a pair of integrally formed locking tabs 72 which are folded to overlie the end wall 66 to reinforce the end wall 66. A dimple 74 is formed at a central location on the end wall 66.

The bolt 90 is a solid metal member which can be formed by conventional casting or powder metallurgy techniques. The bolt 90 has a generally rectangular cross section which corresponds to that of the passage 70. The bolt 90 has a tapered left end 92 configured, as is conventional, to permit the bolt 90 to be retracted in response to slamming engagement with a suitably configured strike (not shown). The bolt 90 has a flat right end 94. The bolt 90 has a receiving formation which preferably takes the form of an elongate slot 96 provided in the central part of the bolt 90. The bolt slot 96 has left and right end walls 100, 102 at its opposite ends. A threaded hole 98 is formed in the bolt 90 near its right end 94. The hole 98 opens downwardly and communicates with the bolt housing slot 80.

Figure 4:
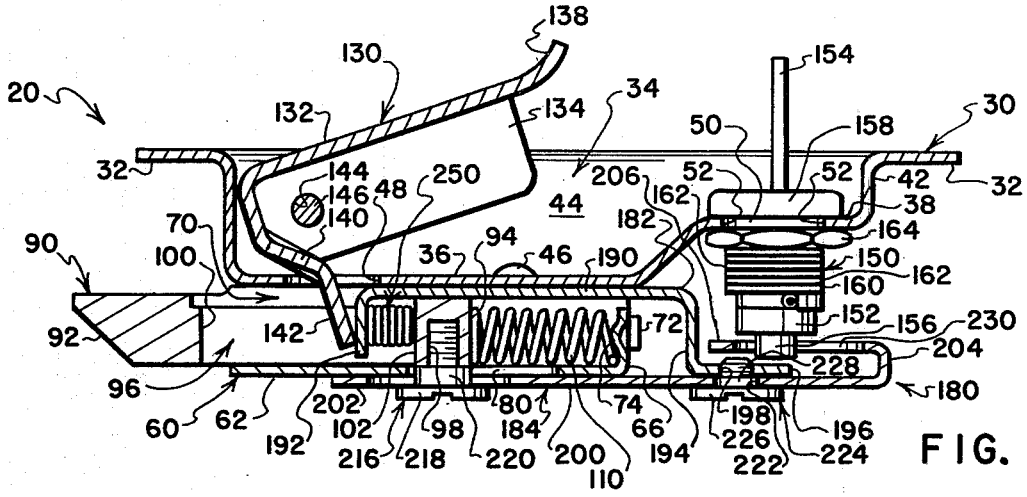
FIG. 4 is a sectional view similar to FIG. 3 with the components of the lock being positioned in a locked attitude, with the handle extended to an operating position, and with the bolt nonetheless still in its projected position.
Figure 5:
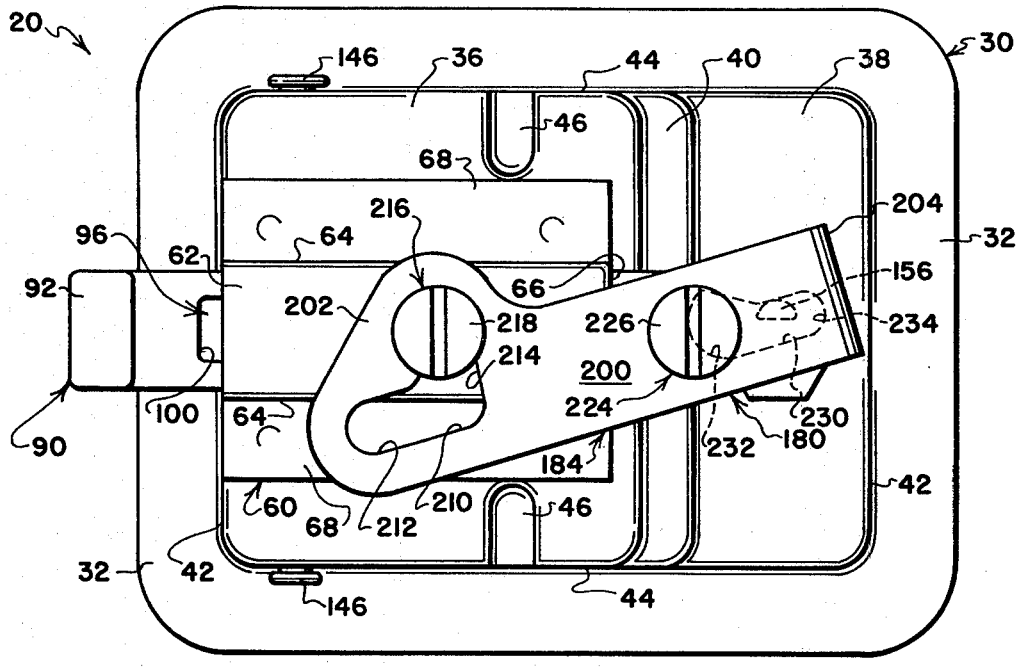
FIG. 5 is a rear elevational view similar to FIG. 2 with the components of the lock being positioned in an unlocked attitude, with the handle nested and the bolt projected; and, FIG. 6 is a sectional view similar to FIG. 4 with the components of the lock being positioned in an unlocked attitude, with the handle extended to an operating position and with the bolt retracted.
Figure 6:
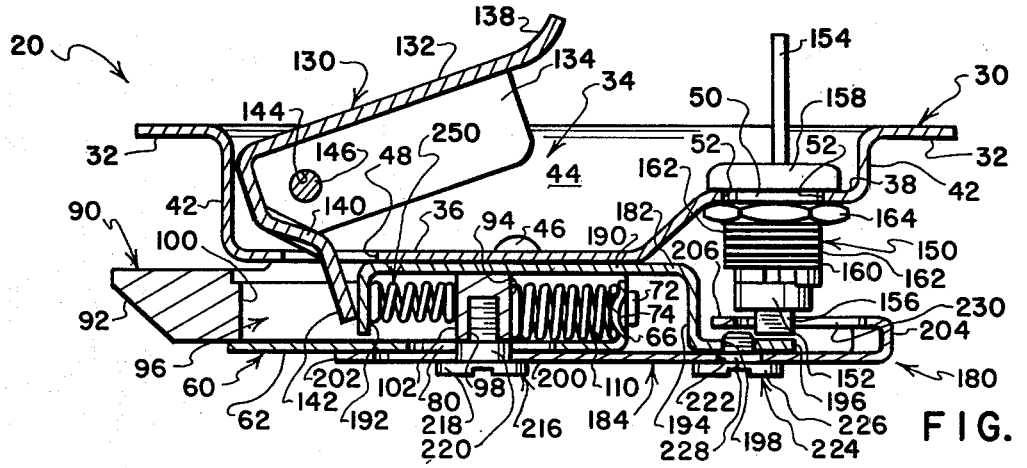

The bolt 90 is movable between a projected or latching position, shown in FIGS. 1–5, and a retracted or unlatching position shown in FIG. 6. When the bolt 90 is projected, its tapered left end 92 extends beyond the left edge of the body flange 32. When the bolt 90 is retracted, its tapered left end 92 extends substantially evenly with the left edge of the body flange 32.

The compression coil spring 110 is positioned in the passage 70. The spring 110 has a left end which engages the bolt end 94, and a right end which engages the bolt housing end wall 66. The dimple 74 extends into the right end of the spring 110 to help retain the spring 110 in place. The spring 110 biases the bolt 90 leftwardly toward its projected position, and is compressed to progressively greater degrees as the bolt 90 is retracted.

The paddle handle 130 is a sheet metal stamping having a generally rectangular, substantially flat plate portion 132 and a pair of opposed, inwardly-turned side flanges 134. An outwardly-turned gripping flange 138 is provided at the right end of the handle 130, and an inwardly-turned operating flange 140 is provided at the left end. An operating arm 142 is formed as an integral projection of the operating flange 140.

The handle 130 has aligned mounting holes 144 formed through its side flanges 134. A headed pin 146 extends through the body holes 54 and through the handle mounting holes 144 to pivotally mount the handle 130 on the body 30 at a location between the body side walls 44.

Figure 2:
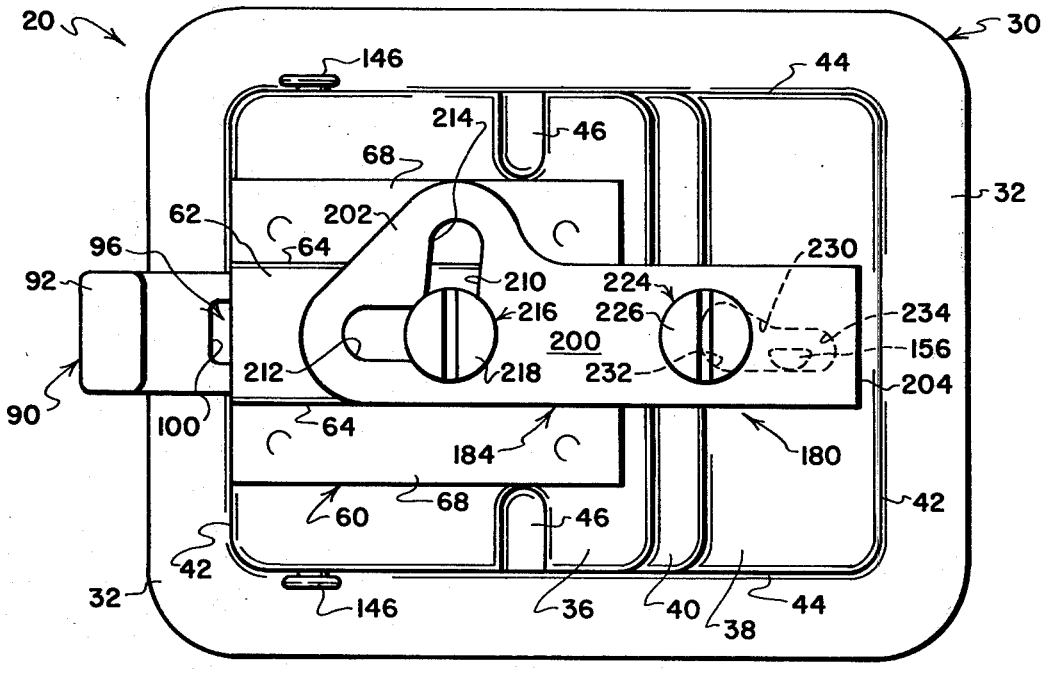
FIG. 2 is a rear side elevational view of the lock of FIG. 1 with the components of the lock positioned as shown in FIG. 1.

The handle operating arm 142 extends through the back wall slot 48 and into the bolt slot 96. When the handle 130 is in its normal nested position, as shown in FIGS. 1–3, the spring 110 biases the bolt 90 leftwardly toward its extended position. At the same time, the spring 250 biases the disconnect member 180 leftwardly into engagement with the operating arm 142 and, in turn, biases the handle 130 clockwise, as viewed in FIG. 3, toward a nested position wherein the handle side flanges 134 engage the bottom wall stops 46.

When the handle 130 is moved out of its nested position to an operating position by pivoting it counterclockwise about the axis of the pin 146, as viewed in FIGS. 4 and 6, one or the other of the springs 110, 250 will be compressed depending on whether the disconnect member 184 is in what will be termed its "connecting" position or its "disconnecting" position. When the disconnect member 184 is in its disconnecting position, as shown in FIGS. 1–4, the disconnect member 184 provides no driving connection between the handle 130 and the bolt 90 whereby, when the handle 130 is pivoted about the axis of the pin 146, no corresponding movement of the bolt 90 takes place. In FIGS. 5 and 6, the disconnect member 184 is in its connecting position wherein it provides a driving connection between the handle 130 and the bolt 90. When the disconnect member 184 is in its connecting position, the bolt 90 is caused to retract rightwardly in the passage 70 as the handle 130 pivots out of its nested position, as shown in FIG. 6.

As is seen in FIGS. 3, 4 and 6, the operating arm 142 is normally spaced from the left end surface 100 of the slot 96. The spacing between the slot end surface 100 and the operating arm 142 provides a lost motion connection which permits the bolt 90 to be retracted, i.e. moved rightwardly in the passage 70, without requiring corresponding pivotal movement of the handle 130. This feature is desirable because it provides the lock 20 with a capability to be "slammed" to bring the bolt 90 into latching engagement with a suitably configured strike (not shown) without causing the handle 130 pivot out of its nested position.

The key control 150 includes a lock cylinder 152 into which a key 154 may be inserted. The key 154 is configured to cooperate with tumblers housed within the cylinder 152 to permit a locking member 156 to be rotated between locked and unlocked positions. The locked position of the locking member 156 is shown in FIGS. 1–4. The unlocked position of the locking member 156 is shown in FIGS. 5–6.

The cylinder 152 is provided with an enlarged head 158 and a threaded body 160. A pair of flats 162 are formed on opposite sides of the threaded body 160. The cylinder 152 is positioned with its head 158 engaging the forward surface of the right body portion 38, with its body 160 extending through the hole 50, and with its flats 162 engaging the flat surfaces 52. A locknut 164 is threaded onto the body 160 to hold the cylinder 152 in place on the lock body 30.

While the key control 150 is of a conventional, commercially available type, it is selected from among various commercially available key controls which have particular operational characteristics. These operational characteristics should include key removal capability when the locking member 156 is positioned in either of its locked and unlocked positions. A further characteristic of the key control 150 is that, once the locking member 156 has been positioned in either of its locked or unlocked positions and the key 154 has been removed from the cylinder 152, the key control 150 maintains the locking member 156 in such position.

Referring to FIGS. 4 and 6, the mounting member 182 has an elongate, flat central section 190. Downwardly turned portions 192, 194 are provided at the left and right ends of the central section 190. A right end portion 196 parallels the plane of the central portion 190. A threaded hole 198 is formed through the right end portion 196. The central portion 190 is slidably received between the bolt housing end wall 66 and the lock body back wall portion 36, and extends along the upper side of the bolt 90. The left end portion 192 depends into the bolt slot 96. The right end portion 196 extends in a plane which is common to that of the bottom wall 62 of the bolt housing 60.

The disconnect member 184 has an elongate main section 200 which underlies and extends alongside the bottom wall 62 of the bolt housing 60, and which projects rightwardly, as viewed in FIG. 3, to a position underlying the key control 150. As is best seen in FIG. 2, the main section 200 has an enlarged left end region 202. As is best seen in FIGS. 4 and 6, a U-shaped bend 204 is provided at the right end of the main section 200 and connects the relatively long main section 200 with a relatively short right end section 206.

Referring to FIGS. 2 and 5, a V-shaped slot 210 is provided in the enlarged left end region 202. The slot 210 has a first leg 212 which extends longitudinally of the central section 200, and a second leg 214 which extends laterally of the central section 200. As is best seen in FIGS. 4 and 6, a threaded fastener 216 extends through the disconnect member slot 210, through the bolt housing slot 80, and is threaded into the bolt hole 98. The fastener 216 has an enlarged head 218 which underlies portions of the main section 200 and thereby retains the disconnect member 184 closely alongside the bottom wall 62 of the bolt housing 60. The fastener 216 has a cylindrical formation 220 which slip fits within the slots 210, 80 and thereby permits relative movement between the fastener 216 and the disconnect member 184. Since the fastener 216 is secured to the bolt 90, it moves with the bolt 90 as the bolt 90 slides within the passage 70.

A hole 222 is formed through the main section 200 at a location near its right end. A threaded fastener 224 extends through the disconnect member hole 222 and is threaded into the mounting member hole 198. The fastener 224 has an enlarged head 226 which underlies parts of the main section 200 and thereby retains the main section 200 in position closely underlying the right end 196 of the mounting member. The fastener 224 has a cylindrical formation 228 which slip fits within the hole 222, whereby the fastener 224 is operative to establish a pivotal connection between the mounting member 182 and the disconnect member 184.

An elongate slot 230 is formed in the right end section 206. As is best seen in FIG. 2, the slot 230 has an enlarged left end 232 and a relatively smaller right end 234. The locking member 156 projects into the slot 230. When the locking member 156 is in its locked position, as shown in FIG. 2, it engages one side of the slot 230 and causes the disconnect member 184 to assume a disconnecting position wherein the leg 212 of the V-shaped slot 210 is aligned with the bolt passage 70. When the locking member 156 is in its unlocked position, as shown in FIG. 5, it engages the opposite side of the slot 230 and causes the disconnect member 184 to assume a connecting position wherein the cylindrical formation 220 of the fastener 216 is received within the leg 214 of the slot 210.

When the locking member 156 is in its locked position and thereby causes the disconnect member 184 to assume its disconnecting position as shown in FIG. 2, pivotal movement of the handle 130 from its nested position, shown in FIG. 3, to an operating position, shown in FIG. 4, will cause the mounting member 182 to move rightwardly carrying with it the disconnect member 184. During this movement, the slot leg 212 will move rightwardly to receive the cylindrical formation 220 of the fastener 216, whereby no driving connection will be made between the disconnect member 184 and the bolt 90. Stated in another way, when the locking member 156 is in its locked position as shown in FIG. 2, the disconnect member 184 is positioned such that no driving connection is established between the handle 130 and the bolt 90. Under these circumstances, the handle 130 can be moved freely without causing any corresponding movement of the bolt 90, as is illustrated in FIG. 4.

When the locking member 156 is in its unlocked position and thereby causes the disconnect member 184 to assume its connecting position as shown in FIG. 5, pivotal movement of the handle 130 from its nested position to its operating position will cause the mounting member 182 to move rightwardly carrying with it the disconnect member 184 and the bolt 90, as shown in FIG. 6. Stated in another way, when the locking member 156 is in its unlocked position as shown in FIG. 5, the disconnect member 184 is positioned such that a driving connection is established between the handle 130 and the bolt 90. Under these circumstances, movement of the handle 130 to its operating position will cause corresponding retracting movement of the bolt 90, as is illustrated in FIG. 6.

The reason for the elongate character of the slot 230 which receives the locking member 156 is to provide the lock 20 with a "slam" capability. Regardless of whether the disconnect member 184 is in its connecting or disconnecting position, if the tapered end 92 of the bolt 90 is slammed into engagement with a suitably configured strike (not shown), the bolt 90 will move rightwardly within the passage 70. The elongation of the slot 230 permits the bolt 90 to move rightwardly, carrying with it the disconnect member 184, without transmitting any forces to the locking member 156.

Referring to FIG. 3, the compression coil spring 250 has a left end which engages the left end 192 of the mounting member 182, and a right end which engages the right end wall 102 of the bolt slot 96. By this arrangement, the spring 250 biases the mounting member 182 leftwardly, and with it the disconnect member 184. The spring 250 also biases the handle 130 toward its nested position. The spring 250 biases the bolt 90 relatively rightwardly and the mounting member 182 relatively leftwardly but, by virtue of the cylindrical formation 220 of the fastener 216 engaging the right end of the disconnect member slot 210, the degree of extension of the spring 250 is limited to that shown in FIG. 3.

While the handle return spring 250 has been shown interposed between the bolt 90 and the disconnect member 182, an alternate approach is to eliminate the spring 250 and provide a separate tension coil spring (not shown) at a location behind the body 30 with one end of such spring connected to the body 30 and the other end connected to either of the members 182, 184 to bias the member 182 leftwardly into engagement with the handle operating arm 142.

Although the invention has been described in its preferred form with a certain degree of particularity, it is understood that the present disclosure of the preferred form is only by way of example and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A door lock, comprising:

(a) a body structure;

(b) a bolt structure connected to the body structure for movement between latching and unlatching positions, the bolt structure having a connecting formation connected thereto for movement along a first path of travel relative to the body structure in response to movement of the bolt structure between its latching and unlatching positions;

(c) a handle structure connected to the body structure for movement between normal and operating positions, the handle structure having an operating formation connected thereto for movement along a second path of travel relative to the body structure in response to movement of the handle structure between its normal and operating positions;

(d) key control means connected to a selected one of the structures and having a locking member which is movable relative to the selected structure between locked and unlocked positions, the key control means being operable to selectively retain the locking member in its locked and unlocked positions;

(e) disconnect means interposed between the operating formation and the connecting formation for selectively drivingly connecting and disconnecting the operating and connecting formations to thereby selectively drivingly connect and disconnect the handle and bolt structures, the disconnect means including mounting means connecting at least a part of the disconnect means to a given one of the structures other than the selected structure for movement:

(i) along a third path of travel relative to the given structure between connecting and disconnecting positions in response to movement of the locking member between its locked and unlocked positions; and, (ii) when the part of the disconnect means is in its connecting position, along a fourth path of travel relative to the body structure in response to movement of the operating formation along the second path of travel;

(f) the disconnect means being operable:

(i) when the part of the disconnect means is in its connecting position, to drivingly connect the handle and bolt structures such that, when the handle structure is moved to its operating position, the bolt structure is caused to move to its unlatching position; and, (ii) when the part of the disconnect means is in its disconnecting position, to provide no driving connection between the handle and bolt structures, whereby the handle structure may be moved freely between its normal and operating positions without causing corresponding movement of the bolt structure;

(g) the mounting means being operable to pivotally mount the part of the disconnect means for movement along the third path of travel relative to the given structure about a pivot axis, whereby the third path of travel is caused to take the form of an arc having the pivot axis as its center of radius;

(h) the bolt structure having a projection formed thereon;

(i) the disconnect means part having an L-shaped slot formed therein with one leg of the slots being with the first path of travel when the part is in its disconnecting position, and with the other leg of the slot extending laterally with respect to the one leg; and, (j) the bolt structure projection extending into the L-shaped slot for sliding movement along the first leg when the handle structure is moved while the other of the interconnected members is in its disconnecting position, and for drivingly engaging a side of the second leg when the other of the interconnected members is in its connecting position.

2. The door lock of claim 1 wherein the connecting formation includes an abutment surface formed on the bolt structure.

3. The door lock of claim 2 wherein the abutment surface comprises an end wall of an elongate slot formed in the bolt structure.

4. The door lock of claim 1 wherein structure providing a lost motion connection connects the operating formation and the bolt structure for enabling the bolt structure to be moved from its latching position to its unlatching position without causing corresponding movement of the operating formation.

5. The door lock of claim 1 wherein the body structure includes a first housing member having wall portions including a back wall portion which cooperate to define a forwardly-facing recess, and a second housing member rigidly connected to the first housing member and cooperating therewith to define a passage within which the bolt structure is mounted for movement.

6. The door lock of claim 1 wherein the operating formation includes an abutment surface formed on the handle structure.

7. The door lock of claim 1 wherein:

(a) the handle structure is mounted on the body structure for pivotal movement about a mounting axis; and, (b) the operating formation is connected to the handle structure for pivotal movement about the mounting axis.

8. The door lock of claim 7 wherein a shaft is journaled in aligned holes formed through spaced portions of the body structure, and the axis of the aligned holes defines the mounting axis.

9. The door lock of claim 1 wherein the key control means is mounted on the body structure.

10. The door lock of claim 1 wherein the bolt structure comprises an elongate member mounted on the body structure for sliding movement relative to the body along a linear first path of travel extending longitudinally of the elongate member.

11. The door lock of claim 1 wherein the operating formation is pivotally mounted on the body structure for movement along an arcuate second path of travel.

12. The door lock of claim 1 wherein the locking member is rotatably mounted by the key-control means and carries an eccentric formation which extends into a slot formed in a selected region of the disconnect means for drivingly interconnecting the locking member and the disconnect means.

13. The door lock of claim 1 additionally including biasing means interposed between the bolt and body structures for biasing the bolt structure toward its latching position.

14. A door lock, comprising:

(a) a body structure;

(b) a bolt structure connected to the body structure for movement between latching and unlatching positions, the bolt structure having a connecting formation connected thereto for movement along a first path of travel as the bolt structure moves between its latching and unlatching positions;

(c) a handle structure connected to the body structure for movement between normal and operating positions, the handle structure having an operating formation connected thereto for movement along a second path of travel as the handle structure moves between its normal and operating positions;

(d) disconnect means interposed between the connecting formation and the operating formation, at least a part of the disconnect means being movable along a third path of travel into and out of intersection with a selected one of the first and second paths of travel as the part of the disconnect means moves between connecting and disconnecting positions, the disconnect means being operable:

(i) when the part of the disconnect means is in its connecting position, to cooperate with the connecting and operating formations to drivingly connect the handle and bolt structures such that, when the handle structure is moved to its operating position, the bolt structure is caused to move to its unlatching position; and, (ii) when the part of the disconnect means is in its disconnecting position, to provide no driving connection between the handle and bolt structures;

(e) key-control means connected to one of the structures and being operable to move the part of the disconnect means between its connecting and disconnecting positions and to selectively releasably retain the part of the disconnect means in its connecting and disconnecting positions;

(f) guide means for:

(i) mounting the part of the disconnect means for pivotal movement along a third path of travel as the part of the disconnect means moves between its connecting and disconnecting positions; and, (ii) mounting at least a portion of the disconnect means for translatory movement along a fourth path of travel while the part of the disconnect means is in its connecting position and while the disconnect means establishes a driving connection between the handle and bolt structures;

(h) the bolt structure having a projection formed thereon;

(i) the disconnect means part having an L-shaped slot formed therein with one leg of the slots being with the first path of travel when the part is in its disconnecting position, and with the other leg of the slot extending laterally with respect to one leg; and, (j) the bolt structure projection extending into the L-shaped slot for sliding movement along the first leg when the handle structure is moved while the other of the interconnected members is in its disconnecting position and for drivingly engaging a side of the second leg when the other of the interconnected members is in its connecting position.

15. The door lock of claim 14 wherein the operating formation is pivotally mounted on the body structure such that the second path of travel is curved along its length.

16. The door lock of claim 14 wherein:

(a) a first abutment surface is defined on the operating formation;

(b) a second abutment surface is defined on the part of the disconnect means; and, (c) the first and second abutment surfaces are configured to drivingly engage each other when (i) the part of the disconnect means is positioned in its connecting position and (ii) the handle structure is moved from its normal position to its operating position.

17. The door lock of claim 14 wherein the key-control means is mounted on the body structure.

18. The door lock of claim 14 wherein the bolt structure comprises an elongate member mounted on the body structure for sliding movement relative to the body structure along a linear first path of travel extending longitudinally of the elongate member.

19. A door lock, comprising:

(a) a body structure;

(b) a bolt structure connected to the body structure for movement between latching and unlatching positions, the bolt structure having a connecting formation connected thereto and being movable along a first path of travel between latching and unlatching positions;

(c) a handle structure connected to the body structure for movement between normal and operating positions, the handle structure having an operating formation connected thereto and being movable along a second path of travel as the handle structure moves between its normal and operating positions;

(d) disconnect means interposed between the operating formation and the connecting formation, and including a disconnect member, the disconnect member being movable into and out of driving engagement with a selected one of the connecting and operating formations as the disconnect member moves between connecting and disconnecting positions, the disconnect means being operable:

(i) when the disconnect member is in its connection position, to drivingly engage the selected one of the formations to drivingly connect the handle structure and bolt structures such that, when the handle structure is moved to its operating position, the bolt structure is caused to move to its unlatching position; and, (ii) when the disconnect member is in its disconnecting position, to disengage the selected one of the formations to provide no driving connection between the handle and bolt structure;

(e) key-control means connected to one of the structures and having a locking member movable between locked and unlocked positions, the key-control means being operable;

(i) when the locking member is in its unlocked position, to position the disconnect member in its connecting positions; and, (ii) when the locking member is in its locked position, to position the disconnect member in its disconnecting position;

(f) the disconnect means additionally including guide means for:

(i) mounting at least a part of the disconnect member for lateral movement relative to the and, (ii) confining at least a segment of the disconnect means against lateral movement relative to the first path of travel;

(g) first biasing means biasing at least a portion of the disconnect means into engagement with the other of the connecting and operating formations;

(h) the disconnect member having an L-shaped slot formed therein, one leg of which is aligned with the second path of travel when the disconnect member is in its disconnecting position, the other leg of which extends laterally of the first leg; and, (i) the connecting formation extending into the L-shaped slot for sliding movement in the first leg when the handle structure is moved while the disconnect member is in its disconnecting position, and for drivingly engaging a side of the second leg when the disconnect member is in its connecting position.

20. The door lock of claim 19 wherein the first and second paths of travel are spaced from but overlie each other.

21. The door lock of claim 19 wherein the guide means includes a slot formed in the bolt structure, and the segment of the disconnect member is confined by the slot against moving laterally relative to the first path of travel.

22. The door lock of claim 19 wherein:

(a) the operating formation is pivotally movable about a first axis of rotation as the handle structure moves between its normal and operating positions;

(b) the guide means mounts the disconnect member for pivotal movement about a second axis as the disconnect member moves between its connecting and disconnecting positions; and, (c) the first axis of rotation extends in a plane which is substantially perpendicular to a plane within which the second axis extends.

23. The door lock of claim 19 wherein:

(a) a first abutment surface is defined on the operating formation;

(b) a second abutment surface is defined on the portion of the disconnect means; and, (c) the biasing means biases the disconnect member to maintain driving engagement between the first and second abutment surfaces.

24. The door lock of claim 23 wherein:

(a) the disconnect means additionally includes a mounting member and structure pivotally connecting the mounting member and the disconnect member; and, (b) the second abutment surface is defined on the mounting member.

25. The door lock of claim 24 wherein the mounting member extends along one side of the bolt structure, the disconnect member extends along the other side of the bolt structure, and the structure pivotally interconnecting the mounting member and the disconnect member is located near one end of the bolt structure.

26. The door lock of claim 19 wherein a selected one of the locking member and the disconnect means is provided with an elongate formation which cooperates with an interfitting formation provided on the other of the locking member and the disconnect means, the elongate formation and the interfitting formation being configured to permit translatory movement of the disconnect means without transmitting forces to the locking member.

27. The door lock of claim 26 wherein the elongate formation is provided on the disconnect means, and the interfitting formation is provided on the locking member.

28. The door lock of claim 19 additionally including second biasing means interposed between the body structure and the bolt structure for biasing the bolt structure toward its latching position.

29. The door lock of claim 28 wherein the first biasing means is interposed between the bolt structure and the portion of the disconnect means.

30. The door lock of claim 19 wherein:

(a) the body structure has an elongate slot formed therein extending alongside the second path of travel; and, (b) the connecting formation extends through the elongate slot and is engageable with one end of the slot when the bolt structure is in its latching position.

31. A flush-mountable door lock, comprising:

(a) a body structure having side and back walls which cooperate to define a forwardly-facing recess, and having an opening formed through the body structure;

(b) an elongate bolt structure movably connected to the body structure, the bolt being movable relative to the body structure along a first path of travel between latching and unlatching positions;

(c) a handle structure mounted on the body structure and being movable between a nested position wherein the handle structure is nested within the recess, and an operating position;

(d) key-control means connected to one of the structures and including a locking member movable between locked and unlocked positions;

(e) an operating formation connected to another of the structures and extending through the back wall opening and into the receiving formation of the bolt structure;

(f) disconnect means interposed between key-control means and the operating formation, the disconnect means including a pair of pivotally interconnected members which are relatively movable between a connecting position wherein the pivotally interconnected members are operable to drivingly interconnect the handle and bolt structures such that when the handle structure is moved out of its nested position the bolt structure is caused to retract, and a disconnecting position wherein no driving connection is provided between the handle and bolt structure;

(g) one of the interconnected members including a projection formed on the bolt structure;

(h) the other of the interconnected members including an L-shaped slot having one leg which is aligned with the first path of travel, and one leg which extends laterally of the first leg; and (i) the bolt structure projection extends into the L-shaped slot for sliding movement along the first leg when the handle structure is moved while the other of the interconnected members is in its disconnecting position and for drivingly engaging a side of the second leg when the other of the interconnected members is in its connecting position.

32. The door lock of claim 31 wherein the pivotally interconnected members are movable relative to each other about a disconnect pivot axis which is not common to the first path of travel followed by the bolt structure in moving between its latching and unlatching positions.

33. The door lock of claim 32 wherein the first path of travel extends along an imaginary line, and the disconnect pivot axis intersects the imaginary line.

34. The door lock of claim 33 wherein:

(a) the handle structure is mounted on the body structure for pivotal movement about a handle pivot axis; and, (b) the handle pivot axis, the linear path of travel, and the disconnect pivot axis extend in substantially mutually perpendicular directions.

35. A flush-mountable door lock, comprising:

(a) a body structure having side and back walls which cooperate to define a forwardly-facing recess, and having an opening formed through the back wall;

(b) an elongate bolt structure slidably supported on the body structure at a location behind a portion of the back wall, the bolt structure being movable between a projected position wherein the bolt structure is extended with respect to the body structure, and a retracted position wherein the bolt structure is retracted with respect to the body structure, the bolt structure having a receiving formation communicating with the back wall opening;

(c) a handle structure mounted on the body structure and being movable between a nested position wherein the handle structure is nested within the recess, and an operating position;

(d) connecting means carried by the handle structure and being movable therewith, the connecting means extending through the back wall opening and into the receiving formation of the bolt structure;

(e) disconnect linkage means having a first element extending into the receiving formation for engaging the connecting means and having a portion extending longitudinally of the bolt structure toward the key-control means, the disconnect linkage means additionally having a second element which is coupled to the first element and which is movable between a connecting position wherein it is operable to cooperate with the first element to drivingly interconnect the handle and bolt structures such that when the handle structure is moved out of its nested position the bolt structure is caused to retract, and a disconnecting position wherein no driving connection is provided between the handle and bolt structures;

(f) key-control means carried by the body structure and including a locking member movable between locked and unlocked positions;

(g) the locking member being engageable with the second element of the disconnect linkage means for moving the second element to its connecting position when the locking member is moved to its unlocked position, and for moving the second element to its disconnecting position when the locking member is moved to its locked position;

(h) the body structure has an elongate slot formed therein along one side of the bolt structure and paralleling the path of travel followed by the bolt structure in moving between its projected and retracted positions;

(i) a connecting formation is carried by the bolt structure and extends through the elongate slot;

(j) the second element drivingly engages the connecting formation when in its connecting position, and disengages the connecting formation when in its disconnecting position;

(k) the second element has an L-shaped slot formed therein, one leg of which is aligned with the second path of travel when the disconnect member is in its disconnecting position, the other leg of which extends laterally of the first leg; and, (l) the connecting formation extends into the L-shaped slot for sliding movement in the first leg when the handle structure is moved while the disconnect member is in its disconnecting position and for drivingly engaging a side of the second leg when the disconnect member is in its connecting position.

36. The door lock of claim 35 wherein the key-control means is mounted on the body structure.

37. The door lock of claim 36 wherein the locking member is rotatably mounted for movement between its locked and unlocked positions.

38. The door lock of claim 37 wherein the key-control means is mounted on the body structure and has a rotatable cylinder which supports the locking member for rotation.

* * * * *

UNITED STATES PATENT AND TRADEMARK OFFICE

CERTIFICATE OF CORRECTION

PATENT NO. : 4,321,812

DATED March 30, 1982

INVENTOR(S) : Albert L. Pelcin

It is certified that error appears in the above-identified patent and that said Letters Patent are hereby corrected as shown below:

Col. 12, line 46, delete "connection" and substitue -- connecting --

Col. 13, line 2, after "the" add -- first path of travel as the disconnect member moves between its connecting and disconnecting positions; --

Signed and Sealed this

*Fourteenth* Day of *September 1982*

[SEAL]

*Attest:*

GERALD J. MOSSINGHOFF

*Attesting Officer*

*Commissioner of Patents and Trademarks*